United States Patent [19]

Gilman et al.

[11] Patent Number: 4,668,470

[45] Date of Patent: May 26, 1987

[54] FORMATION OF INTERMETALLIC AND INTERMETALLIC-TYPE PRECURSOR ALLOYS FOR SUBSEQUENT MECHANICAL ALLOYING APPLICATIONS

[75] Inventors: Paul S. Gilman, Suffern; Arun D. Jatkar, Monroe; Stephen Donachie, New Windsor; Winfred L. Woodard, III, Midland Park; Walter E. Mattson, West Milford, all of N.J.

[73] Assignee: Inco Alloys International, Inc., Huntington, W. Va.

[21] Appl. No.: 809,312

[22] Filed: Dec. 16, 1985

[51] Int. Cl.[4] ..... B22F 1/00

[52] U.S. Cl. ..... 419/32; 75/249; 148/415; 419/33; 419/45; 419/46; 419/63; 420/528; 420/540; 420/550; 420/552; 420/590

[58] Field of Search ..... 420/528, 550, 540, 552, 420/590; 75/249; 148/415; 419/32, 33, 45, 46, 63

[56] References Cited

U.S. PATENT DOCUMENTS

| | | | |
|---|---|---|---|
| 4,292,079 | 9/1981 | Pickens et al. | 419/11 |
| 4,297,136 | 10/1981 | Pickens et al. | 75/234 |
| 4,443,249 | 4/1984 | Weber et al. | 148/11.5 P |
| 4,532,106 | 7/1985 | Pickens | 75/233 |
| 4,557,893 | 12/1985 | Jatkar et al. | 419/13 |
| 4,600,556 | 7/1986 | Donachie et al. | 148/12.7 A |

*Primary Examiner*—Stephen J. Lechert, Jr.

*Attorney, Agent, or Firm*—Raymond J. Kenny; Edward A. Steen

[57] ABSTRACT

A method for forming intermetallic and intermetallic-type precursor alloys for subsequent mechanical alloying applications. Elemental powders are blended in proportions approximately equal to their respective intermetallic compounds. Heating of the blend results in the formation of intermetallic compounds whereas lack of heating results in intermetallic-type powder without the intermetallic structure. The resultant powder is then blended to form a final alloy. Examples involving aluminum-titanium alloys are discussed.

9 Claims, 6 Drawing Figures

FORMATION OF INTERMETALLIC AND INTERMETALLIC-TYPE PRECURSOR ALLOYS FOR SUBSEQUENT MECHANICAL ALLOYING APPLICATIONS

TECHNICAL FIELD

The instant invention relates to mechanical alloying techniques in general and more particularly to a method for making and utilizing precursor alloy powders. Mechanically alloyed precursors may act as alloy intermediates to expeditiously form final mechanically alloyed systems. Both intermetallic compositions and non-intermetallic ("intermetallic-type") compositions having the same weight percent as the intermetallic compound but not its structure are generated.

BACKGROUND ART

In recent years there has been an intensive search for new high strength metallic materials having low relative weight, good ductility, workability, formability, toughness, fatigue strength and corrosion resistance. These new materials are destined for aerospace, automotive, electronic and other industrial applications.

The use of powder metallurgy techniques and, more particularly, mechanical alloying technology has been keenly pursued in order to obtain these improved properties. Additionally, powder metallurgy generally offers a way to produce homogeneous materials, to control chemical composition and to incorporate dispersion strengthening materials into the alloy. Also, difficult to handle alloying materials can be more easily introduced into the alloy by powder metallurgical techniques than by conventional ingot melting techniques.

The preparation of dispersion strengthened powders having improved properties by mechanical alloying techniques has been disclosed by U.S. Pat. No. 3,591,362 (Benjamin) and its progeny. Mechanically alloyed materials are characterized by fine grain structure which is stabilized by uniformly distributed dispersoid particles such as oxides and/or carbides.

Mechanical alloying, for the purpose of this specification, is a relatively dry, high energy milling process that produces composite powders with controlled extremely fine microstructures. The powders are produced in high energy attritors or ball mills. Typically the various elements (in powder form) and processing aids are charged into a mill. The balls present in the mill alternatively cause the powders to cold weld and fracture ultimately resulting in a very uniform powder distribution.

Aluminum, in particular, lends itself very well to lightweight parts fabrication—especially for aerospace applications. Aluminum, when alloyed with othe constituents, is usually employed in situations where the maximum temperature does not exceed about 204°-260° C. (400° F.-500° F.). At higher temperatures, current aluminum alloys lose their strength. However, it is desired by industry to develop aluminum alloys that are capable of successfully operating up to about 482° C. (900° F.). Developmental work utilizing aluminum along with titanium, nickel, iron and chromium systems in proceeding in order to create new alloys capable of functioning at the higher temperature levels.

To date it has been extremely difficult to mechanically alloy aluminum alloys that contain elemental additions that are significantly harder than the aluminum matrix, i.e., aluminum with Ni, Fe, Cr, V, Ce, Zr, Zn and/or Ti. When directly processing these alloys at the desired composition, the aluminum powder cold welds around the harder alloy constituent forming composite powder particles of aluminum embedded with large, segregated, unalloyed elemental additions.

SUMMARY OF THE INVENTION

The instant invention relates to a method for making and mechanically alloying metallic powders having an intermetallic compound composition that can be subsequently re-mechanically alloyed to form alloys of a final desired composition.

The technique involves mechanically alloying a powder blend corresponding to an intermetallic composition, optionally reacting the powder at an elevated temperature so as to form the intermetallic structure, using the resultant powder as one of the alloying additions to form a final powder blend, blending the other material additions to the final powder blend and then mechanically alloying the resultant powder mixture.

Alternatively, by foregoing the heating step, the resulting intermetallic-type composition while possessing the intermetallic composition, that is, the appropriate weight percents, will not be in intermetallic form.

PREFERRED MODE FOR CARRYING OUT THE INVENTION

Figure 1:
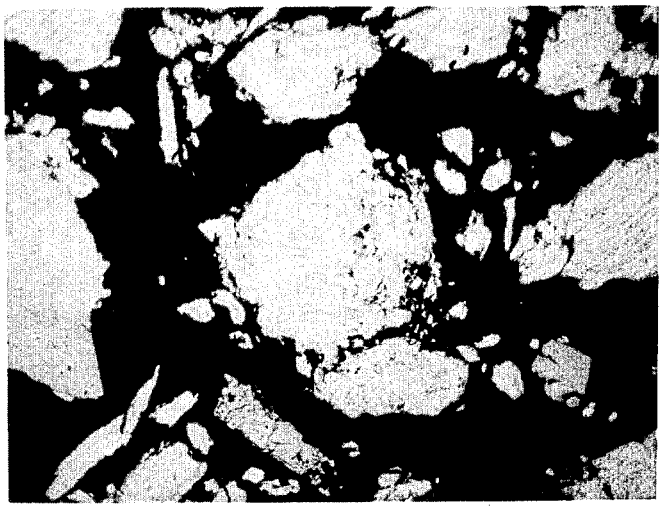
FIG. 1 is a photomicrograph of the "as-attrited" precursor alloy taken at 150 power.

Although the following discussion centers principally on aluminum it should be recognized that the technique may be utilized with other alloy bases (i.e., titanium, nickel, iron, etc.) as well. The disclosed process essentially creates an intermetallic form for any alloy.

The instant alloys may be formed by first mechanically alloying a combination of aluminum and the harder alloying elements where the concentration of the harder alloying addition is sufficiently greater than that of the final target composition. For many systems the components may be mixed at a level corresponding to one of the intermetallic compounds of the alloy system. Once processing is complete, the powder may be heated to complete the formation of the intermetallic. Using a higher concentration of alloying element reduces the damping efficiency of the aluminum powder matrix in protecting the alloying addition from being refined by the mechanical alloying. This allows the hard elemental addition to be finely dispersed throughout the aluminum matrix during mechanical alloying.

As was alluded to earlier, standard mechanical alloying techniques utilizing current equipment may result in non-homogenous distributions. The various constituents of the alloy remain discrete and segregated; a state-of-affairs which adversely impacts upon the characteristics of the alloy and reduces its usefulness.

It was envisioned that by producing a precursor alloy composition before final processing and then combining this composition with the other powder components to form the target alloy composition, better distribution and less segregation of the constituents would result. Then by mechanically alloying the resultant mixture, the final alloy would have the desired characteristics. The precursor composition, may be in certain situations, an intermetallic composition. Additionally, the precursor alloy will include different percentages of the constituents than the final alloy composition.

For example, in the aluminum-titanium alloy system described herein (which by the way is a non-limiting example), it was envisioned that the final target alloy powder composition was to be about 96% aluminum-4% titanium ("Al 4 Ti") plus impurities and residual processing aids. The precursor alloy, having the weight percentages of the intermetallic composition, is substantially higher in titanium, for example about 63% aluminum-37% titanium (Al 37 Ti).

For the purposes of this specification the principal alloy component shall be defined as the element having the highest percentage by weight in any alloy and the secondary alloy component shall be the remaining element (or elements). Accordingly, in the above example aluminum may be regarded as the prinicpal element in both the precursor alloy and the final alloy whereas titanium is the secondary element in both alloys.

It was first determined that by boosting the level of the secondary element in the precursor alloy and then mechanically alloying it, the crystalline structure of the precursor alloy would be so altered as to form an intermetallic and allow it to be expeditiously combined with the principal element so as to form the final alloy. The final alloy, after mechanical alloying, has the desired homogeneous structure. From subsequent experiments it was determined that the the intermetallic-type (non-intermetallic) version having the percentage composition of the intermetallic also resulted in a desirable final alloy powder.

It is extremely difficult if not virtually impossible to mechanically alloy aluminum and titanium when attempting to formulate the final Al 4Ti target alloy. A uniform structure is difficult to achieve. Accordingly, by forming the precursor alloy $Al_3Ti$, and then blending the precursor alloy with aluminum powder (the principal element of the final alloy), the desired target alloy is formed having the requisite uniform structure.

The following describes the fabrication of an Al-3Ti precursor powder that was subsequently diluted for re-mechanical alloying to a final Al-4Ti alloy. The Al-Ti precursor alloy in an "as-attrited" condition and in a "reacted" and screened condition was diluted with additional aluminum powder to form the target alloy.

An experiment was directed towards making a precursor alloy corresponding to the intermetallic $Al_3Ti$ composition—about 62.8 wt % Al and 37.2 wt % Ti (Al 37Ti). A laboratory scale attritor was used for all experiments. The aluminum powder used was air atomized aluminum which is the normal feedstock for commercially available mechanically alloyed aluminum alloys. The starting titanium powder was crushed titanium sponge.

The processing conditions were as follows:

| | | |
|---|---|---|
| Ball charge: | 68 kg. | |
| Powder charge: | 3632 grams broken down as: | |
| | Wt. % | Weight (Grams) |
| Ti | 37.2 | 1324 |
| Al | 62.8 | 2235 |
| Process Control Agent (Stearic Acid) | 2 | 73 |

Notes:
Stearic acid was added as 2% of total charge. All processing was performed in argon.

The Al-Ti-stearic acid blend was added entirely at the beginning of the run. The powder precursor was processed for 3.5 hours. A portion (referred to as the "reacted" alloy) of the processed Al-Ti precursor alloy was vacuum degassed in a furnace at 537.7° C. (1000° F.) for two hours and then completely cooled under vacuum. Any non-oxidizing atmosphere (helium, argon, etc.) may be employed as well. The reacted precursor alloy was crushed and screened to −325 mesh prior to re-attriting with aluminum powder to fabricate the target Al 4Ti alloy. The non-reacted precursor alloy is referred to as the "as attrited" precursor alloy.

Both versions of the target Al-4Ti alloy were processed into 3.632 kg. runs using the following four combinations of precursor alloy and stearic acid. The milling conditions were the same as for the formation of the precursor alloy.

| Run | Processing Time |
|---|---|
| 1. Aluminum + ("As Attrited") precursor alloy + 1% Stearic Acid | 3.5 hr |
| 2. Aluminum + ("As Attrited") precursor alloy + 2% Stearic Acid | 3 hr |
| 3. Aluminum + "Reacted" precursor alloy + 1% Stearic Acid | 4.5 hr |
| 4. Aluminum + "Reacted" precursor alloy + 2% Stearic Acid | 3.5 hr |

Runs 1 and 3 included 0.35 kg. of stearic acid, 0.4 kg. of precursor alloy powder and 3.2 kg. of aluminum powder. Runs 2 and 4 included 0.73 kg. of stearic acid, 0.4 kg. of precursor alloy powder and 3.16 kg. of aluminum powder.

The "as attrited" Al-37Ti precursor alloy is shown in FIG. 1. Each powder particle is apparently a non-intermetallic Al-Ti composite with the titanium particles distributed in the aluminum matrix. The embedded titanium particles are approximately 7 micrometers in diameter.

Figure 2:
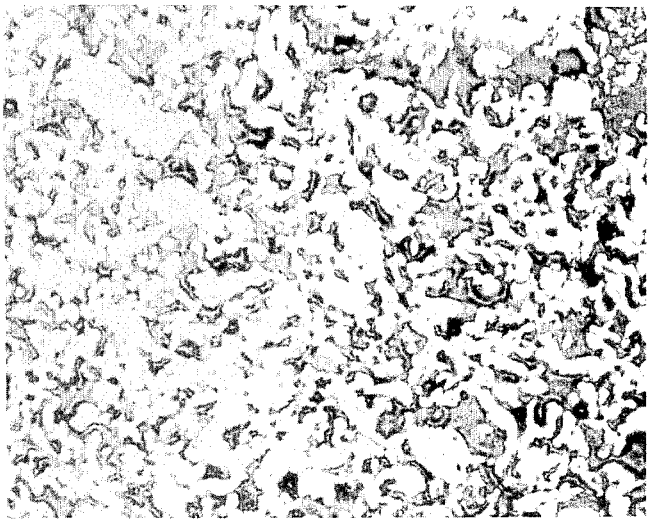
FIG. 2 is a photomicrograph of the "reacted" precursor alloy taken at 150 power.
Figure 3:
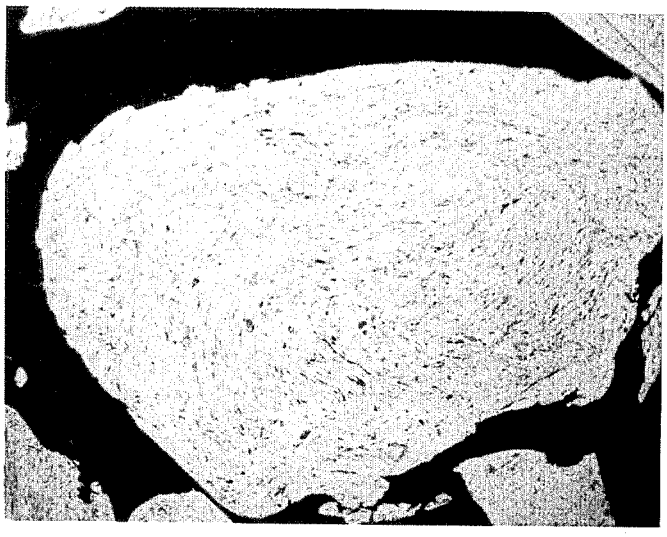
FIGS. 3 and 4 are photomicrographs of the "as attrited" precursor alloy after processing taken at 150 power.
Figure 4:
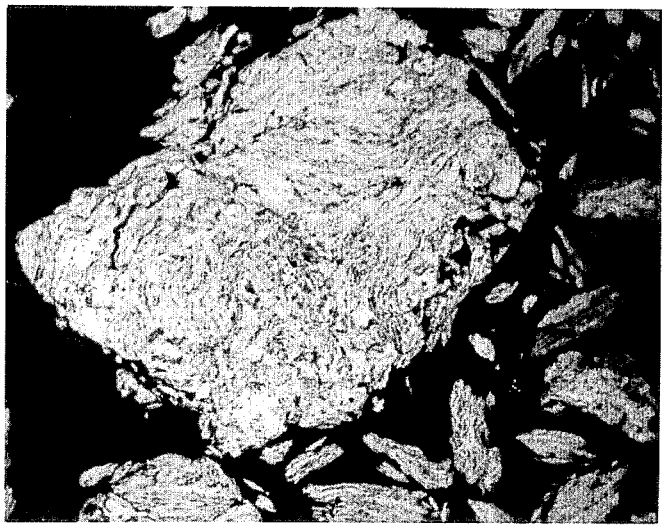
Figure 5:
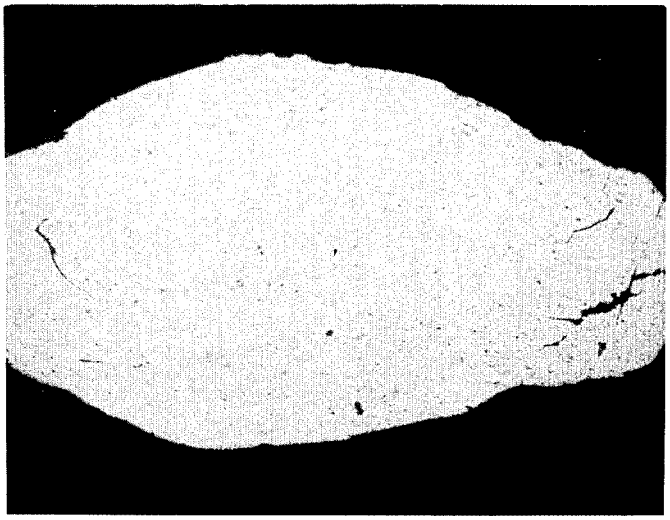
FIGS. 5 and 6 are photomicrographs of the "reacted" precursor alloy after processing taken at 150 power.
Figure 6:
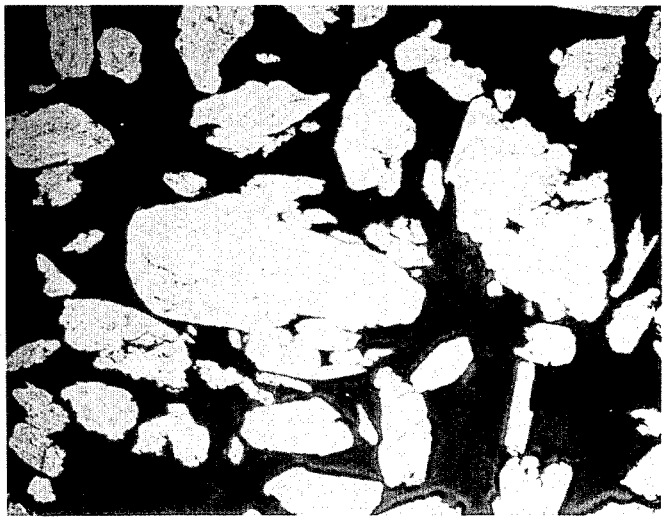

The elevated heating temperature, 537.7° C. (1000° F.), breaks down the stearic acid and, in combination with the milling action, assists in the formation of the new intermetallic crystalline structure $Al_3Ti$. After reacting the precursor alloy powder the powder morphology and microstructure are drastically changed. See FIG. 2. The particles have a flake-like morphology and their internal constituents can no longer be resolved.

The selection of Al 37Ti as the precursor alloy composition is dictated by the formation of the intermetallic compound $Al_3Ti$ at these percentages. See the Al-Ti phase diagram in *Constitution of Binary Alloys,* 2nd edition, page 140, by M. Hansen, McGraw Hill, 1958. The temperature selected for the experiments herein (537.7° C. or 1000° F.) was arbitrarily selected. However, it was purposely ketp below the solidus temperature of the element having the lowest melting point—in this case aluminum (665° C. or 1229° F.). Melting is to be avoided.

If it is desired to form a precursor alloy having an intermetallic composition and the attendant intermetallic structure, then the above heating step ("as reacted") is required. On the other hand, if it is desired only to have the composition of the intermetallic composition, but not the structure ("intermetallic-type"), the heating operation is forgone.

Al-4Ti made with both versions of the precursor alloy were processed with either one or two percent stearic acid and are shown in FIGS. 3 through 6.

Processing Al-4Ti using "as attrited" precursor alloy with 1% stearic acid led to little refinement in the distribution of the precursor alloy in the aluminum matrix. See FIG. 3. At the 1% stearic acid level cold welding predominates flaking and particle fracturing. The Al-Ti precursor alloy is merely spread along the cold welded aluminum particle layers. Also, the processed aluminum particles are cold weld agglomerates.

Increasing the stearic acid content to 2% produces an Al-Ti powder that is very similar in structure to commercially available IN-9052 mechanically alloyed powder (Al 4Mg). See FIG. 4. The Al-Ti precursor alloy is well refined and is not easily distinguishable in the powder particle microstructure.

A process control agent ("PCA") such as stearic acid ($CH_3(CH_2)_{16}COOH$) tends to coat the surfaces of the metal powders and retards the tendency of cold welding between the the powder particles. Otherwise, the mechanical alloying process would soon cease with the powder cold welding to the balls and walls of the attritors. The PCA reduces the cold welding of the powder particles and leads to better homogenation and laminar structure.

Reacting the Al-Ti precursor alloy and screening it to −325 mesh prior to mechanical alloying with 1% stearic acid produced a powder similar to that made with "as attrited" precursor alloy. See FIG. 5. Again, the 1% stearic acid level appeared to be inadequate for producing a proper balance of flaking, fracturing and cold welding. Increasing the stearic acid content (say, to 2% or more) appears to improve the processing of the alloy. See FIG. 6. However, the "reacted" Al-Ti precursor alloy addition did not appear to be refined to the level of the "unreacted" precursor alloy. This is not believed to undesirably impact upon the characteristics thereof.

The quantity of stearic acid may range from about 0.5% to about 5% (in weight percent) of the total powder charge. The quantity of any PCA added is equal to the amount sufficient enough to expedite powder fracturing and reduce cold welding. Although in the nonlimiting examples given herein 2% stearic acid proved satisfactory, the quantity of stearic acid or any other PCA is a function of the powder composition and type of milling apparatus (ball mill or attritor) employed. Accordingly, different permutations will require different PCA levels.

The processing of aluminum with high concentrations of titanium and using the resulting powder as a precursor alloy addition to dilute alloys appears to be successful. This technology should be directly applicable to other hard elemental additions such as Zr, Cr, Fe and Ni.

The resultant powders may be consolidated to shape using ordinary convential methods and equipment.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention is which an exclusive property or privilege is claimed are defined as follows:

1. A method for making homogeneous intermetallic dispersion strengthened powder compositions, the method comprising:

(a) blending elemental powders comprising the intermetallic composition and a process control agent into a blend, the elemental powders including a principal element and at least one secondary element, the secondary element having a different hardness than the principal element, (b) mechanically alloying the blend, and (c) heating the blend below the solidus temperature of all of the elements to form the intermetallic composition.

2. The method according to claim 1 wherein a process control agent is present in the blend in an amount sufficient to expedite powder fracture and reduce cold welding.

3. A method for forming homogeneous intermetallic dispersion strengthened $Al_3Ti$ powder, the method comprising:

(a) blending about 62.8% aluminum powder and about 37.2% titanium powder, (b) mechanically alloying the aluminum-titanium powder blend in a non-oxidizing environment, and (c) heating the blend to a temperature below the solidus temperature of aluminum so as to form an aluminum-titanium intermetallic composite power.

4. The method according to claim 3 wherein the heating operation occurs at about 1000° F.

5. The method according to claim 3 wherein a process control agent is added to the blend.

6. The method according to claim 5 wherein the process control agent is stearic acid present from about 0.5% to about 5% of the blend.

7. A method for forming a homogeneous intermetallic dispersion strengthened aluminum-base alloy powder, the method comprising:

(a) blending aluminum powder and at least one secondary element powder in the same proportions as a corresponding intermetallic composition, to form a blend, (b) mechanically alloying the blend, and (c) heating the composition to a temperature below the solidus temperature of each of the elements so as to form the intermetallic composition.

8. The composition according to claim 6 wherein the process control agent is present in the blend in an amount sufficient to expedite powder fracture and reduce cold welding.

9. The method according to claim 7 wherein the element included in the secondary element powder is harder than aluminum.

* * * * *